United States Patent [19]

Kilgore

[11] 4,223,964

[45] Sep. 23, 1980

[54] TISSUE HOLDER

[76] Inventor: Bobby R. Kilgore, 603 School St., Rossville, Ga. 30741

[21] Appl. No.: 22,051

[22] Filed: Mar. 19, 1979

[51] Int. Cl.[3] ..... B65H 19/00

[52] U.S. Cl. ..... 312/39; 312/188

[58] Field of Search ..... 312/37, 38, 39, 188, 312/197, 204

[56] References Cited

U.S. PATENT DOCUMENTS

| | | | |
|---|---|---|---|
| 901,520 | 10/1908 | Burris | 312/39 |
| 2,647,028 | 7/1953 | Larson | 312/39 |
| 3,413,049 | 11/1968 | Smay | 312/39 |
| 4,108,513 | 8/1978 | Lander | 312/39 |

*Primary Examiner*—Casmir A. Nunberg

[57] ABSTRACT

A holder for a roll of bathroom tissue, including a cylindrical case with a slot along a side thereof, through which the tissue paper is dispensed, a pivotable door at one end of the case, a roll-supporting peg at a center of the case, and the case being supported either directly on a wall or upon a pedestal post.

1 Claim, 4 Drawing Figures

TISSUE HOLDER

This invention relates generally to bathroom accessories. More specifically, it relates to bathroom tissue roll holders.

It is well known that, in most homes, a roll of bathroom tissue is supported on a wall near a toilet, and is exposed to view so that it makes an unsightly appearance. This is objectionable to a fastidious person, and is therefore in want of an improvement.

Accordingly, it is a principal object of the present invention to provide a tissue holder, which encloses the tissue roll so as to hide if from view, and which can be attractively painted, so as to harmonize with the decor of a room.

Another object is to provide a tissue holder, which keeps the tissue in a more sanitary condition, so as not to be touched by children, or have room air dust to settle thereupon.

Yet another object is to provide a tissue holder, which, in one design thereof, is upon a pedestal, so as to be movable in room location, and which, due to its novelty, is a conversation piece.

Other objects are to provide a tissue holder, which is simple in design, inexpensive to manufacture, rugged in construction, easy to use, and efficient in operation.

These, and other objects, will be readily evident, upon a study of the following specification, and the accompanying drawing, wherein.

Figure 1:
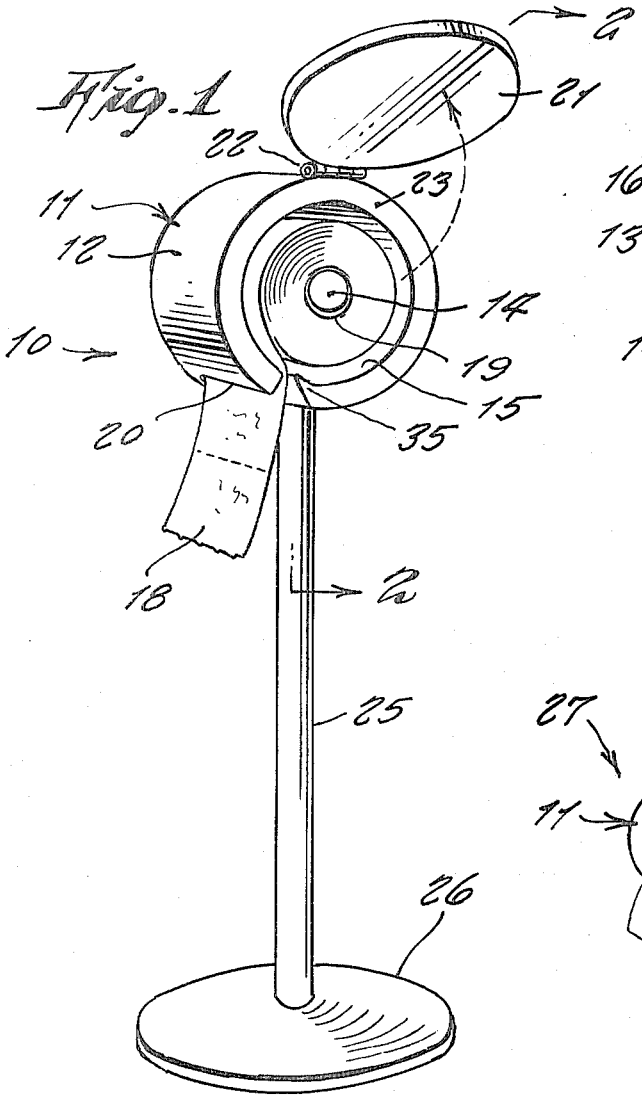
FIG. 1 is a perspective view of the invention.
Figure 2:
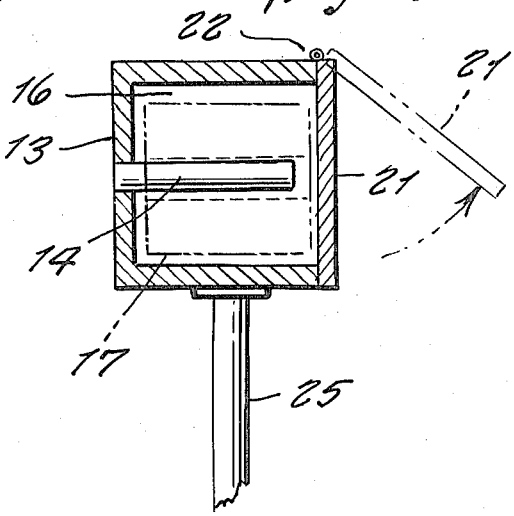
FIG. 2 is a side cross-sectional view thereof, taken on line 2—2 of FIG. 1.

Referring now to the drawing in greater detail, and more specifically, to FIGS. 1 and 2 thereof, at this time, the reference numeral 10 represents one design of tissue holder, according to the present invention, wherein there is a horizontally extending, cylindrically-shaped case 11, comprised of a cylindrical side wall 12, and one end wall 13. The case can be made either of wood, plastic, metal or other materials, as wished. A straight peg 14, along a central longitudinal axis of the case, is affixed at its one end to the end wall, the opposite end of the peg being approximately flush with an entry opening 15, at an opposite end of the case. The chamber 16, thus formed inside the case, is sufficient in size so that a conventional roll 17 of toilet paper tissue 18 can be fitted therein, with the peg extending into the roll core central opening 19.

A slot 20, along the side wall 12, is sufficiently long so that the tissue, unwinding from the roll, can extend outwardly therethrough, for being pulled and torn off, as needed. The slot can be made straight, or else longitudinally curved, for sufficient frictional grasp of the tissue, in order that after the exposed tissue is torn off, the roll end does not pull inwardly from the slot, so as to require re-fitting thereof therein.

A circular door 21, of any material, is pivotally attached to the case, by means of a hinge 22 at an uppermost point of the case edge 23, so that the door depends freely downward therefrom, so as to close the case opening. Any decorative design 24 may be painted on an outer side of the door, as shown in FIG. 3.

The case may be mounted on an upper end of a pedestal post 25, having a wide base 26, so as to prevent easy toppling over. The case and pedestal can be made in any color, so as to suit the room decor.

Figure 3:
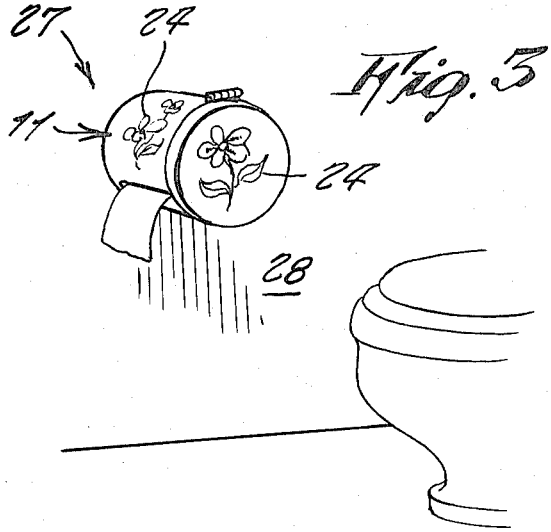
FIG. 3 is a perspective view of a wall model of the invention.

In FIG. 3, another design of tissue holder 27 comprises only the above-described case 11, without a pedestal, and which can be supported on a room wall 28, by means of screws, (not shown), though holes in the case end wall 13.

Figure 4:
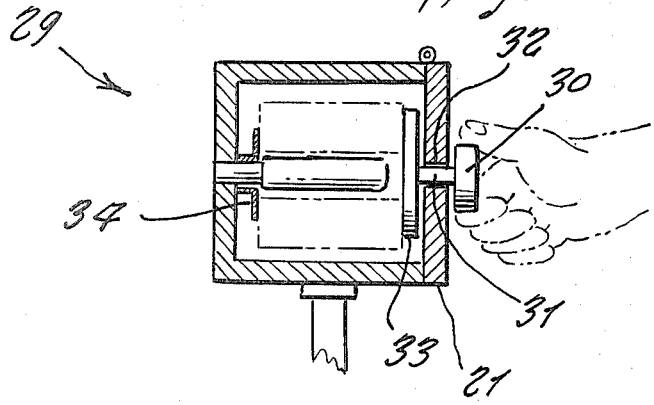
FIG. 4 is a cross-section of another modified design, that includes a friction knob on the door, so as to rotate the tissue roll manually, for easier access for pulling, in case the tissue does not protrude out of the slot.

In FIG. 4, still another design of tissue holder 29 includes a manually rotatable knob 30, in front of the door, the knob being affixed on a shaft 31, extending through a central opening 32 in the door. A flat circular plate 33 is affixed to the inner end of the shaft. By pressing the plate against the end of the tissue roll, and rotating the knob, the roll can be turned in order to bring the tissue end sufficiently outwardly of the slot, so that it can be grasped for pulling, particularly if the tissue has been torn off previously close along the slot edge. A freely rotatable washer 34, against the opposite end of the roll, prevents the roll from frictionally holding against the end wall during the knob rotation.

The inwardly bent inner edge 35 of the slot aids the roll tissue end to find the slot again, in case it slips out therefrom.

While various changes may be made in the detail construction, it is understood that such changes will be within the spirit and scope of the present invention as is defined by the appended claims.

What I now claim is:

1. A tissue holder, comprising, in combination, a cylindrical case having an end wall at its one end, and an opening at its opposite end, a pivotable door closing said opening, a straight peg in the center of said case, secured at its one end in said end wall, said peg supporting a roll of toilet tissue, said case having a slot along a side thereof, through which said tissue is dispensed, and means for support of said case in a bathroom, said means comprising a pedestal post upon a broad base, and a flat, circular friction plate depressible against an end wall of said roll, for selective rotation thereof, said friction plate being inside said case and affixed on a shaft extending through a central opening of said door, and a knob on an exterior end of said shaft for axial movement of said friction plate against said roll, and rotation thereof.

* * * * *